United States Patent [19]

Wilkinson

[11] 4,411,076

[45] Oct. 25, 1983

[54] SHOE CONSTRUCTION

[76] Inventor: Horace A. Wilkinson, 13 Korocan Rd., Lilli Pilli, New South Wales, 2229, Australia

[21] Appl. No.: 308,555

[22] PCT Filed: Jan. 29, 1981

[86] PCT No.: PCT/AU81/00011

§ 371 Date: Sep. 29, 1981

§ 102(e) Date: Sep. 29, 1981

[87] PCT Pub. No.: WO81/02092

PCT Pub. Date: Aug. 6, 1981

[30] Foreign Application Priority Data

Jan. 29, 1980 [AU] Australia ..... PE2154

[51] Int. Cl.[3] ..... A43B 21/00; A43B 21/36

[52] U.S. Cl. ..... 36/34 R; 36/42

[58] Field of Search ..... 36/36 R, 36 B, 36 C, 36/34 R, 24.5, 41, 42

[56] References Cited

U.S. PATENT DOCUMENTS

| | | | |
|---|---|---|---|
| 1,948,967 | 2/1934 | Jassen | 36/36 R |
| 2,050,644 | 8/1936 | Book et al. | 36/34 R |
| 2,713,731 | 7/1955 | Cangemi | 36/34 R |
| 3,043,024 | 7/1962 | Haug | 36/36 R |
| 4,196,485 | 4/1980 | Wilkinson | 36/34 R |

*Primary Examiner*—Werner H. Schroeder
*Assistant Examiner*—Steven N. Meyers
*Attorney, Agent, or Firm*—Beveridge, DeGrandi & Kline

[57] ABSTRACT

A shoe sole and heel construction. The heel consists of metal pins fixed to the sole by means of sockets. Each socket is provided with a cavity in which the enlarged head of a pin is locked by means of a screw. A deformable pad may be located between the screw and the pin head, or the head may be locked in the cavity by means of a hardenable material.

8 Claims, 4 Drawing Figures

SHOE CONSTRUCTION

TECHNICAL FIELD AND BACKGROUND ART

This invention relates to a shoe construction of the kind described in U.S. Pat. No. 4,196,485 in which a heel comprises a plurality of pins the upper ends of which are attached to the sole of the shoe.

In the arrangements disclosed in the above patent, the upper ends of the pins are fixed to an attachment plate which is secured to the lower surface of the heel portion of the shoe sole.

Such arrangements are eminently suitable for use with shoes having a sole moulded of plastics material, particularly nylon, but are unsatisfactory for use with soles of leather. The object of the present invention is to provide a means for attaching such pins to a leather sole, particularly a laminated leather sole.

DISCLOSURE OF INVENTION

The present invention broadly resides in a shoe sole and heel construction whereby a heel comprising a plurality of pins each having an enlarged head at the upper end thereof may be attached to a sole member, characterised in that each pin is attached to the sole member by means of a socket having a cavity therein for the reception of said enlarged head, said cavity opening to the outer face of said socket by a first passage accommodating the shank of said pin and being of a cross-section smaller than said head, said cavity opening to an inner face of the socket by a second passage through which said shank and said head may be passed to locate said head within said cavity, and means fastening said socket to said sole.

Preferably the screw fastening means comprises a screw fastening device passing through the sole member for engagement with a threaded portion of the cavity.

BEST MODE OF CARRYING OUT THE INVENTION

Figure 1:
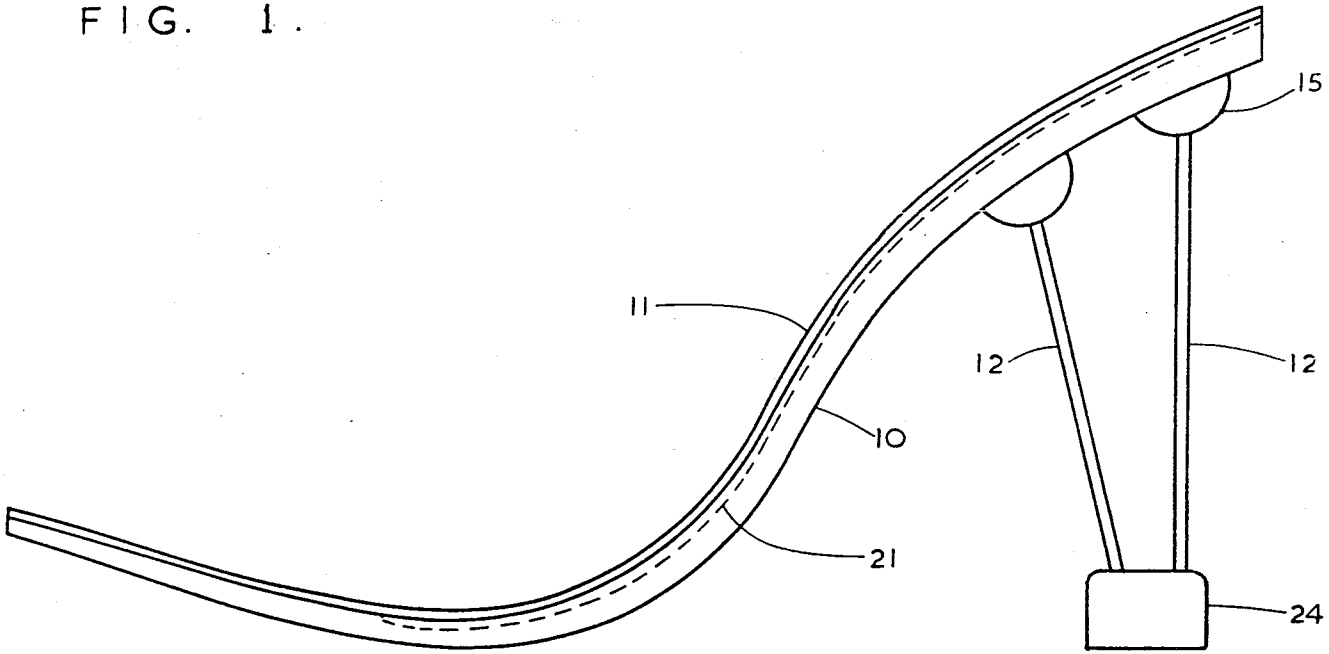
FIG. 1 illustrates in side elevation a shoe embodying the present invention.
Figure 2:
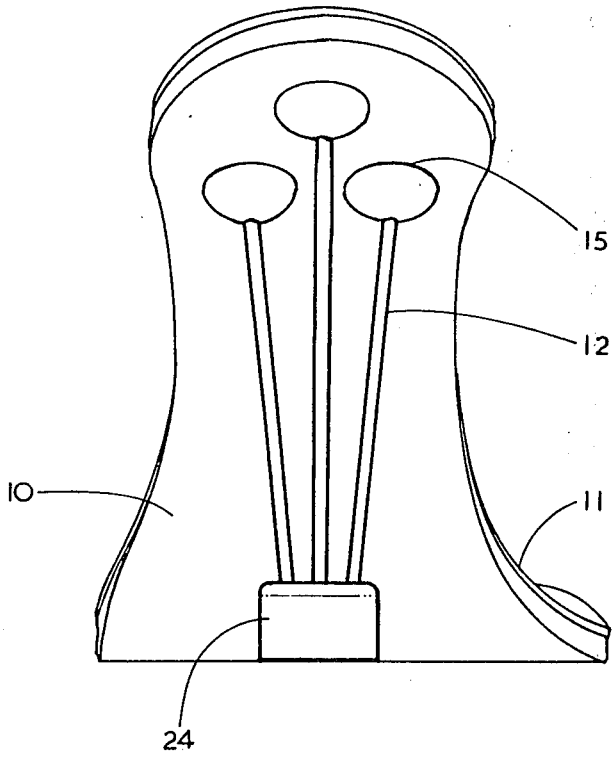
FIG. 2 is an end elevation of the shoe illustrated in FIG. 1.
Figure 3:
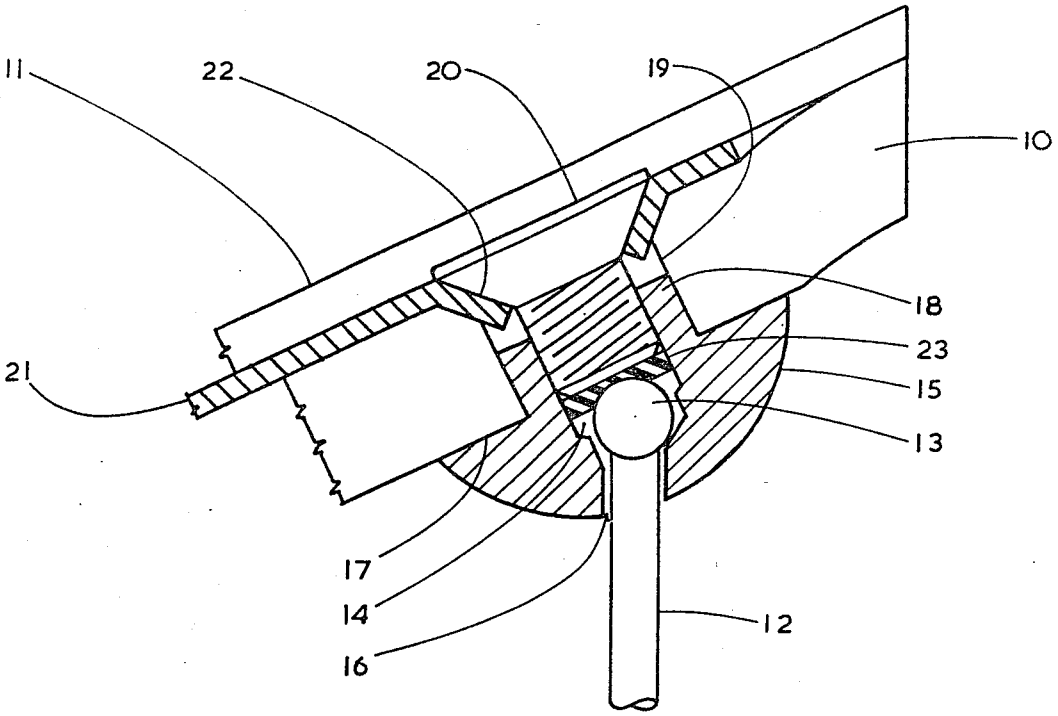
FIG. 3 is a detailed cross-section of the pin fastening arrangement employed in the shoe of FIG. 1.

The shoe illustrated in FIGS. 1 to 3 comprises a laminated leather sole consisting of a lower laminate 10 and an upper laminate 11. The heel of the shoe comprises a plurality of pins 12 each having an enlarged head 13, only one of these pins and its associated fastening elements being illustrated in the fragmentary cross-section view of FIG. 3. Each pin 12 is fixed to the shoe sole by the location of its head 13 within a cavity 14 in a pin head socket 15. This pin head socket is provided with a generally hemispherical outer surface and a passage 16 through which the pin extends, the passage 16 providing a small clearance for the diameter of the pin.

The pin head socket 15 engages the outer surface of the lower sole laminate 10 by means of a flange 17, and is provided with a portion 18 which extends within a circular aperture 19 in the lower sole laminate. Within this portion 18 the side wall of the cylindrical cavity 14 is threaded for engagement with a counter-sink headed screw 20.

Between the sole laminates 10 and 11 there is located a metal tongue 21 fixed to the laminates by adhesive. This tongue extends over the major portion of the length of the sole to impart a desired degree of stiffness to the sole. The tongue 21 is provided with a counter-sunk aperture 22 for reception of the head of the screw 20. Between the lower end of the screw 20 and the end 13 of the pin 12, there is provided a pad 23 of deformable material.

The illustrated structure is assembled by passing the heel pins 12, lower end first, through the cavity 14 and the passageway 16 and fixing the lower ends of the pins in the lower heel member 24 with the aid of a suitable jig. A deformable pad 23 is then placed within each pin head socket cavity and each socket is assembled with the lower sole laminate 10 and the metal tongue 21 by means of the screw 20. As each screw 20 is driven home the pin head socket 15 is drawn tightly against the lower surface of the lower sole laminate 10 and simultaneously the deformable pad 23 is driven against the pin head 13 to lock the pin firmly within the cavity. The sole and heel assembly is then completed by the attachment, by conventional means, of the upper sole laminate 11.

Figure 4:
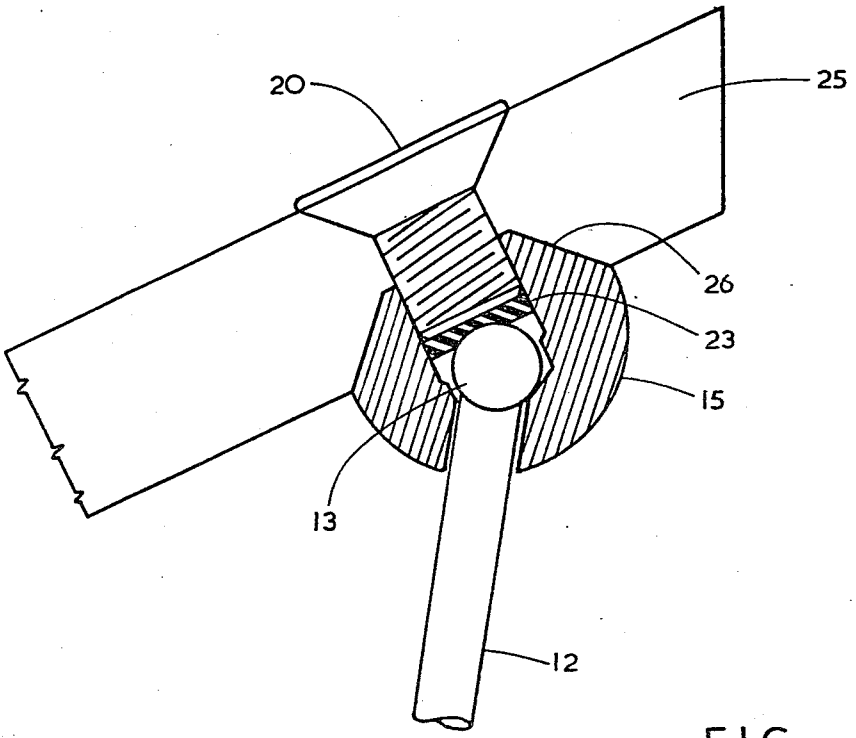
FIG. 4 shows a pin fastening arrangement in accordance with the present invention, applied to a shoe having a synthetic sole.

While principally developed to provide for the attachment of heel pins to laminated leather soles, the present invention may be applied also to soles of synthetic plastics material and a modified form of the arrangement illustrated in FIGS. 1 to 3, is shown in FIG. 4 in fragmentary cross-section, applied to a one-piece sole 25 of plastics material. In this case, the abutting surface of the sole 25 and the pin head socket 15 are conically formed at 26, and the screw 20 engages directly in a counter-sunk recess in the sole 25.

In a further alternative embodiment of the present invention, the deformable pad 23 may be eliminated and instead, the cavity 14 surrounding the pin head 13 may be filled with locking cement or other hardenable material, for example epoxy resin, prior to the final assembly of the components.

The fixing arrangement thus described has been found to provide a structure of great strength which is well adapted for simple and rapid assembly, and which provides a neat and attractive external appearance.

I claim:

1. A shoe comprising a sole member; a plurality of load bearing pin members, each having an enlarged head at one end thereof; a like plurality of socket members, each socket member having a cavity therethrough, each said cavity including a first passage of a first cross-section less than the cross-section of said enlarged head and a second passage of a second cross-section greater than the cross-section of said enlarged head, one pin member passing through each socket member with the shank of each pin member passing through the first passage of its respective socket member and the enlarged head of each pin member within the second passage of the respective socket member; a single lower heel member attached to the second end of each of said pin members; and means for fastening said socket members to said sole member to form a heel for the shoe with said pin members being load bearing members between said lower heel member and said sole member.

2. A construction according to claim 1 in which a portion of each of said cavity second passage is threaded and said fastening mean comprises a plurality of screw fastening devices each passing through said sole member from the side thereof remote from said socket members and engaging with the threaded portion of said second passage of one of said socket members to draw said socket members against the adjacent surface of said sole member.

3. A construction according to claim 2 further comprising deformable means in each said cavity between said screw fastening means and said head of the associated pin member, whereby said head is engaged between said deformable means and the opposed wall of said cavity.

4. A construction according to claim 3 in which said sole member is a moulded sole of plastic material.

5. A construction according to claim 4 in which the surface of each of said socket members engaging said sole member is of substantially frustoconical shape.

6. A construction according to claim 2 in which said sole member is comprised of at least two laminates with a metal tongue therebetween, and in which each of said screw fastening devices passes through said tongue and has a head bearing against said tongue beneath the overlying laminate.

7. A construction according to claim 2 in which said cavity is filled with a hardenable material.

8. A heel construction for a shoe comprising a plurality of load bearing pin members, each having an enlarged head at one end thereof; a like plurality of socket members, each socket member having a cavity therethrough, each said cavity including a first passage of a first cross-section less than the cross-section of said enlarged head and a second passage of a second cross-section greater than the cross-section of said enlarged head, one pin member passing through each socket member with the shank of each pin member passing through the first portion of its respective socket member and the enlarged head of each pin member within the second portion of the respective socket member; a single lower heel member attached to the second end of each of said pin members; and means for fastening said socket members to a shoe sole to form a heel for the shoe with said pin members being load bearing members between said lower heel member and the shoe sole.

* * * * *